US010738400B2

(12) United States Patent
Pass

(10) Patent No.: US 10,738,400 B2
(45) Date of Patent: Aug. 11, 2020

(54) TOOL MODULE FOR TEXTILE MACHINES

(71) Applicant: Groz-Beckert KG, Albstadt (DE)

(72) Inventor: Alexander Pass, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 16/631,512

(22) PCT Filed: Jul. 16, 2018

(86) PCT No.: PCT/EP2018/069266
§ 371 (c)(1),
(2) Date: Jan. 16, 2020

(87) PCT Pub. No.: WO2019/016134
PCT Pub. Date: Jan. 24, 2019

(65) Prior Publication Data

US 2020/0173084 A1 Jun. 4, 2020

(30) Foreign Application Priority Data

Jul. 17, 2017 (DE) ..... 10 2017 116 043

(51) Int. Cl.
*D05C 15/20* (2006.01)
*D04B 27/06* (2006.01)
*D05C 15/10* (2006.01)

(52) U.S. Cl.
CPC ..... *D05C 15/20* (2013.01); *D04B 27/06* (2013.01); *D05C 15/10* (2013.01)

(58) Field of Classification Search
CPC ..... D05C 15/10; D05C 15/20
See application file for complete search history.

(56) References Cited

U.S. PATENT DOCUMENTS 5,295,450 A * 3/1994 Neely ..... D05C 15/22 112/80.45
5,396,852 A 3/1995 Bardsley
(Continued)

FOREIGN PATENT DOCUMENTS

DE 4411277 A1 10/1994
DE 2950619 U1 7/1995
(Continued)

OTHER PUBLICATIONS

German Office Action dated Feb. 9, 2018, in corresponding German Application No. 10 2017 116 043.4, with machine English translation (13 pages).

(Continued)

*Primary Examiner* — Tajash D Patel
(74) *Attorney, Agent, or Firm* — Fitch, Even, Tabin & Flannery LLP

(57) ABSTRACT

The invention relates to a tool module (10) having a module body (11), which has a contact surface (21) and an orienting structure (22). A fastening opening (29) and additionally at least one, preferably a plurality of additional openings (33, 34) extend through the contact surface (21). The area of one additional opening (33) or (34) is larger than, preferably considerably larger than, for example at least twice or three times as large as the cross-sectional area of the fastening opening (29). Thus, a module body (11) is provided, by means of which an increased operating speed of the textile machine can be achieved.

13 Claims, 2 Drawing Sheets

(56) References Cited

U.S. PATENT DOCUMENTS

| | | | | |
|---|---|---|---|---|
| 5,400,727 | A | 3/1995 | Neely | |
| 5,860,373 | A | 1/1999 | Beyer et al. | |
| 5,927,219 | A | 7/1999 | Beyer | |
| 5,947,042 | A | 9/1999 | Beyer et al. | |
| 5,947,942 | A | 9/1999 | Galjour | |
| 5,954,003 | A | 9/1999 | Beyer et al. | |
| 6,116,173 | A | 9/2000 | Beyer | |
| 6,409,030 | B1 | 6/2002 | Schlemper | |
| 7,191,717 | B2 * | 3/2007 | Green | D05C 15/16 112/80.45 |
| 7,575,268 | B2 | 8/2009 | Feussahrens et al. | |
| 9,080,270 | B2 | 7/2015 | Gläsel et al. | |
| 2014/0261121 | A1 | 9/2014 | Woodall et al. | |

FOREIGN PATENT DOCUMENTS

| | | | |
|---|---|---|---|
| DE | 29506820 | U1 | 7/1995 |
| DE | 29506953 | U1 | 8/1995 |
| DE | 29520281 | U1 | 3/1996 |
| DE | 4223642 | C2 | 7/1998 |
| DE | 19928885 | C1 | 3/2001 |
| DE | 10360588 | B4 | 1/2011 |
| DE | 202012104948 | U1 | 1/2013 |
| DE | 102012112553 | B3 | 2/2014 |
| EP | 2072652 | A1 | 6/2009 |
| EP | 2570540 | A1 | 3/2013 |
| JP | S57-176496 | U | 11/1982 |
| WO | 03/056091 | A1 | 7/2003 |

OTHER PUBLICATIONS

International Report on Patentability dated Jul. 24, 2019, in corresponding International Application No. PCT/EP2018/069266, with machine English translation (22 pages).

International Search Report and Written Opinion dated Oct. 11, 2018, in corresponding International Application No. PCT/EP2018/069266, with machine English translation (17 pages).

* cited by examiner

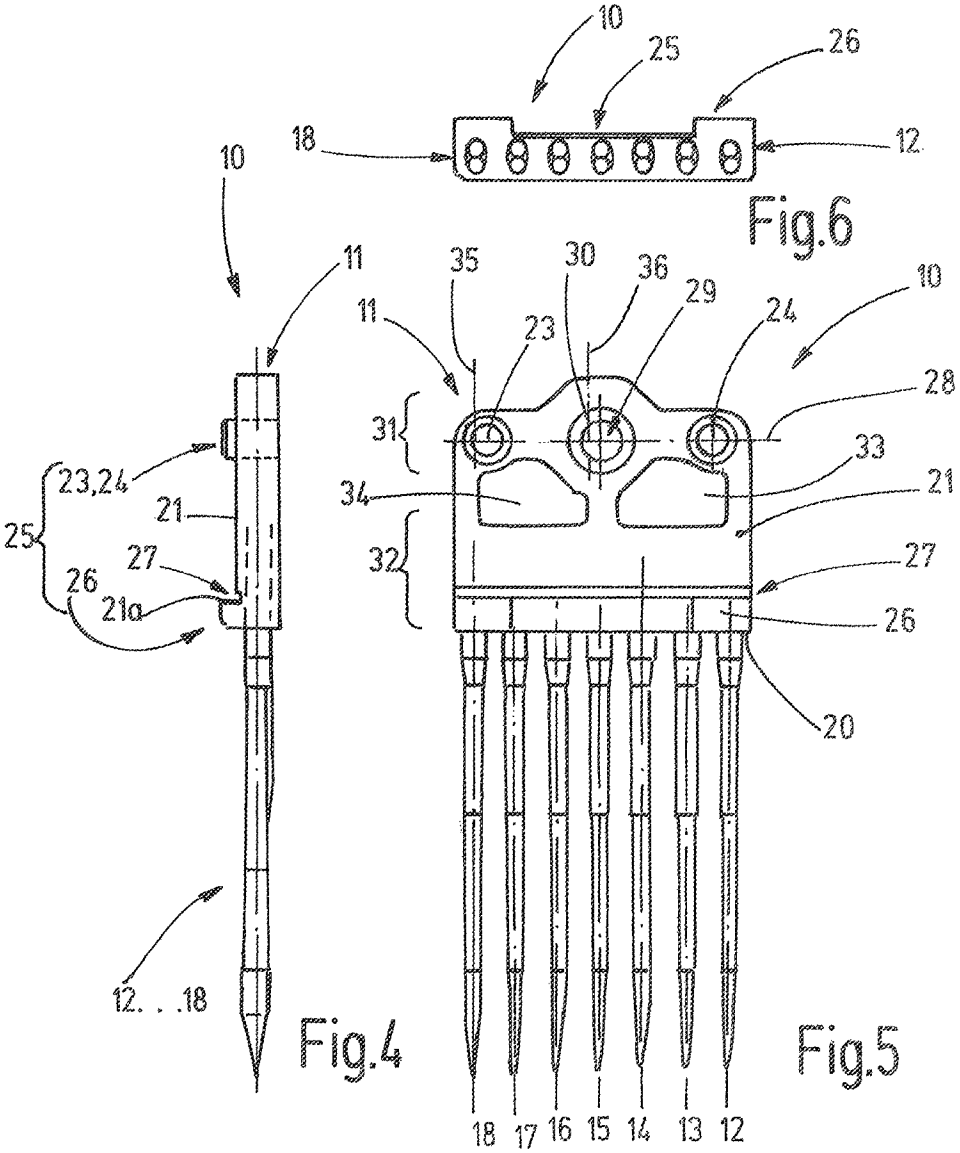
Fig.6
Fig.5
Fig.4
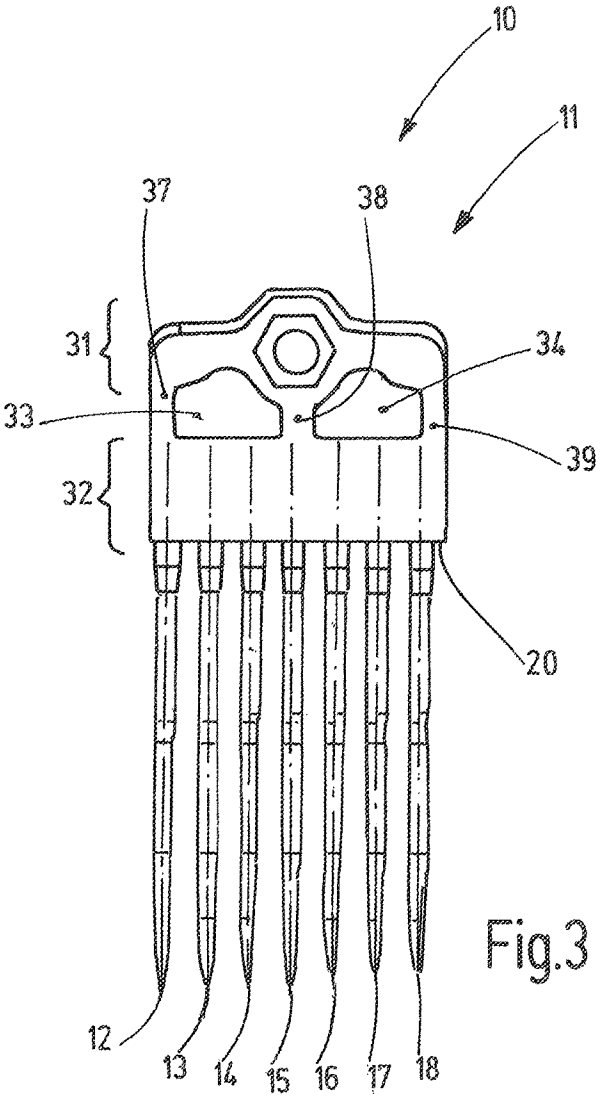
Fig.3

TOOL MODULE FOR TEXTILE MACHINES

CROSS REFERENCE TO RELATED APPLICATIONS

This patent application is the national phase of PCT/EP2018/069266, filed Jul. 16, 2018, which claims the benefit of German Patent Application 10 2017 116 043.4, filed Jul. 17, 2017.

TECHNICAL FIELD

The invention refers to a tool module for textile machines, particularly for tufting applications.

Particularly the invention refers to a tool module for fastening at a bar of a textile machine as, for example, a tufting machine or also a warp knitting machine.

BACKGROUND

The bar of the tufting machine or warp knitting machine is provided with a large number of tools as, for example, grippers, needles, guide needles, knives or the like, that are aggregated by forming groups in modules. Each module comprises a base body in or at which a number of tools is attached. In order to equip the bar with the tools, the modules are connected with the bar.

This principle can be derived from DE 4223642 C2, DE 4411277 A1, U.S. Pat. No. 5,947,942. Thereby, the module bodies are typically provided with form fit structures that simplify a positioning in correct positional arrangement of each module at the bar.

Further, a module with a larger cutout provided in the module body, in which a positioning element can be inserted, is known from DE 19928885 C1. It extends through openings in the module body that are provided with alignment structures in order to come into a correct positional arranged engagement with these openings. The insertion part comprises additional alignment structures that come into contact with forms of the bar that are complementary thereto. A set of different insertion parts provided with different alignment structures allows the adaption to different bar systems.

Further, a tool module is known from DE 10 2012 112 553 B3, the module body of which comprises alignment structures and depressions extending along the alignment structures. They shall serve an improved positioning of the modules at the bar.

A large portion of the drive power provided to the tools of a textile machine is converted into heat due to friction, wherein a relatively large heat proportion is created at the tools. This can lead to a longitudinal extension of the bar that can be disadvantageous for the operation of the machine, particularly in tufting machines and warp knitting machines. Additionally, a remarkable increase of the dynamic loads that particularly act on the bearings and drives as well as an increased bending stress of the bar occurs with increased operation speed, that is oscillation frequency of the bar.

It is the object of the invention to provide a concept with which the operation speed of a textile machine can be increased the tools of which are held in modules.

SUMMARY

This object is solved with a tool module as disclosed herein:

The inventive tool module comprises a module body with a contact surface on or at which an alignment structure for positioning at a bar is provided. The alignment structure comprises at least one projection and/or at least one depression that can come in engagement with a respective complementary form of the bar in order to allow a definite positioning of the tool module at the bar. In the simplest case, the alignment structure is formed by a continuous or interrupted ridge that is arranged at the border of a contact surface with which the module body comes into contact with the bar. Then, the ridge comprises a contact surface that lies on a further surface of the bar. The ridge can be arranged between the contact surface and a narrow side of the module body.

According to the invention, the tool module is penetrated by at least one opening that does not correspond with the fastening opening and thus has neither a fastening function nor a positioning function (form fit function). The opening has preferably a closed border, but can also be an open-jaw-like opening that is open at the laterally narrow sides of the module. The opening that penetrates the contact surface and that is open at the side facing away from the contact surface and separated from the fastening opening reduces the weight of the tool module, reduces the heat transfer surface from the module to the bar and thus reduces also the heat increase of the bar. Additionally, the at least one opening can improve the cooling of the module during the operation of the machine. The heat that is created due to friction of the tools at a backing of another textile or at a thread is received by the module body and dissipated to the environment as well as in now reduced manner to the machine bar. An excessive heat introduction in the bar and thus a length extension thereof during the operation is avoided. In the ideal case, the heat is dissipated in the ambient air. Due to the oscillating operation of a bar with the tools attached thereon convection is enforced. The at least one opening separated from the fastening opening creates an additional swirl of the air that is in contact with the module during the operation of the machine which leads to an increased convection and thus an increased heat dissipation.

The module body is preferably manufactured by a molding process, wherein preferably a zinc alloy is used as molding material. The tools, for example tufting needles, grippers, knives or the like are held with a fastening end in this module body that is molded therein. After the curing and cooling of the module body they can have particularly at its position defining surfaces a certain deviation from the straightness (unevenness), for example at the contact surface. Due to forming of at least one additional opening that penetrates the contact surface and the module body straightness fluctuations of the module body are reduced and the error influence of such straightness deviations on the positioning accuracy is reduced. The clamping situation of the tool module in total is thus increased.

The contact surface of the tool module is the surface that faces the bar and is in contact therewith during operation. Preferably the contact surface is configured as a plane, wherein elements that form part of the alignment structure extend away from the contact surface. Such elements can be projections in the form of prismatic, cylinder-shaped or dome-shaped projections that preferably extend parallel to each other away from the contact surface. Corresponding depressions in the bar are typically assigned to these projections. Additionally or alternatively a continuous or superiorly interrupted ridge is part of these projections that is arranged adjoining to a narrow side of the module body. This narrow side is the side that is penetrated by the tool shanks of the textile tools. If the ridge is interrupted it can be reduced to two projections standing at the corners of the module. This leads to a maximum weight reduction while completely preserving or improving the positioning accuracy. If the ridge is the solely present alignment structure, the modules can be laterally adjusted or shifted at the bar for the machine setup.

The above-mentioned, for example cylinder-shaped or otherwise configured projections are preferably arranged at both sides of the fastening opening on a line that is parallel with the narrow side of the module body and thus to the ridge provided there. Due to this separation a third zone is created between a zone of the module body in which the tool shanks are held and another zone that comprises the fastening opening and the projections at the two sides thereof, in which the additional openings for weight reduction, straightness improvement and convection improvement are arranged. Thus, the zone holding the tool shanks and the zone serving for fastening are connected with each other by two, preferably three webs that are orientated parallel to each other at least two of which, preferably three, can have the same cross-section respectively.

Typically, the fastening opening comprises a diameter that substantially corresponds to the diameter of one of the projections. However, this is not obligatory. It is, however, aimed to adapt the diameter of the fastening opening to the fastening means in order not to excessively weaken the fastening section of the module body. If a certain resilience of the module body is desired at all, it can be provided by the two to three webs extending between the fastening section and the tool section.

BRIEF DESCRIPTION OF THE DRAWINGS

Further details of advantageous embodiments of the invention are subject of the drawings, the description and the claims. The drawings illustrate an embodiment of the invention. The drawings show:

DETAILED DESCRIPTION

Figures 1, 2:
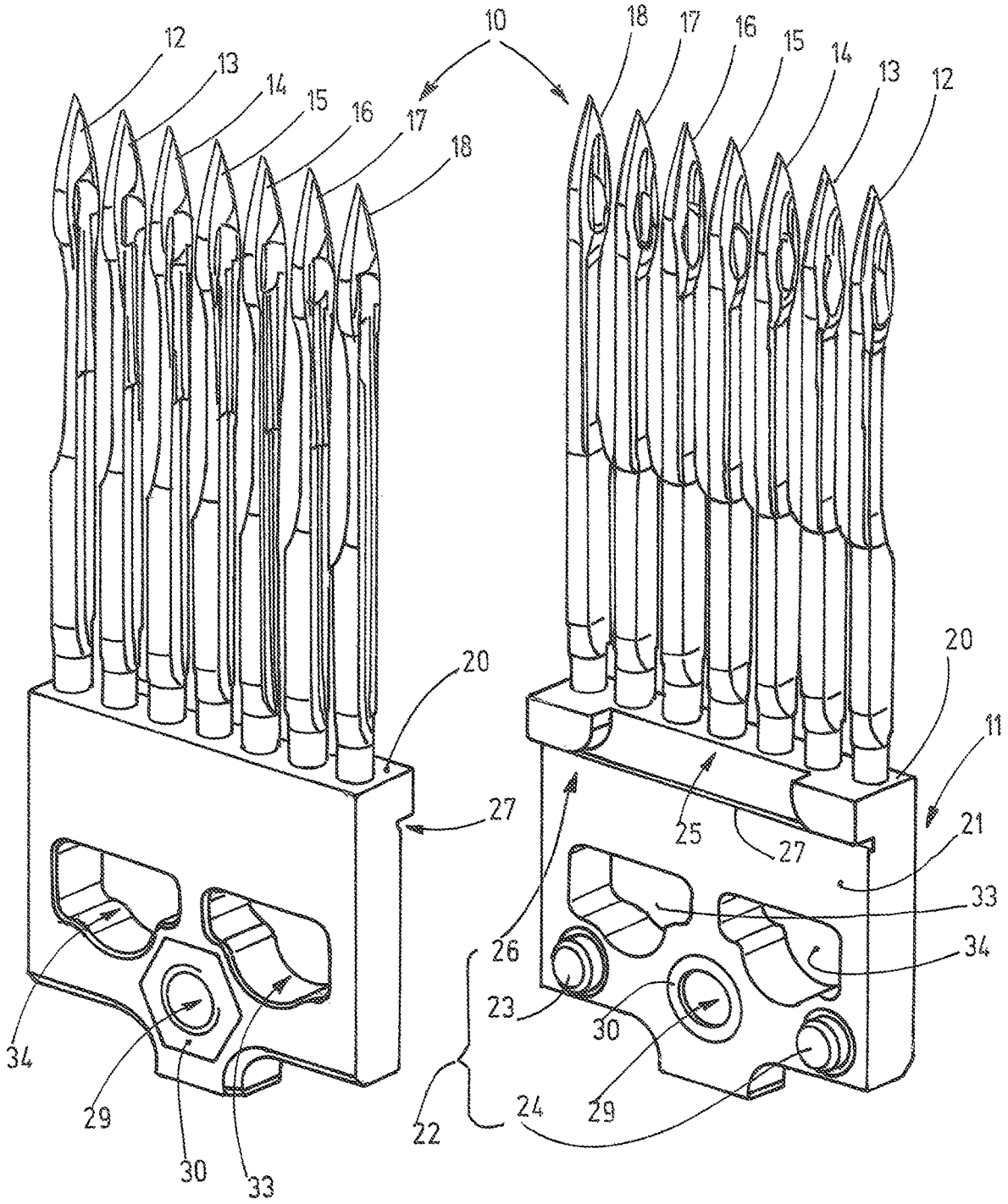
FIG. 1 the inventive tool module in a schematic perspective illustration with view on the contact surface, FIG. 2 the tool module according to FIG. 1 in a perspective illustration with view on its side facing away from the contact surface, FIG. 3 the tool module according to FIGS. 1 and 2 in a top view on the fastening side, FIG. 4 the tool module according to FIGS. 1-3 in a side view, FIG. 5 the tool module according to FIGS. 1-4 in top view on its contact surface, FIG. 6 the tool module according to FIGS. 1-5 with view on the points of the tools.

In FIG. 1, only for exemplary illustration of features of the invention, a tool module 10 is illustrated including a module body 11 and tools 12-18 held at the latter. Tufting needles are exemplarily illustrated as tools. But similarly other tools that operate parallel to each other synchronously as, for example, guide needles, grippers, fingers, knives or the like can be provided. Independent therefrom, the tools 12-18 are arranged parallel to each other and are fixed with its respective shank end in the module body 12. As an example, 7 tools are illustrated. However, tools in any other desired number and also singular tools can be provided at the module body 11.

The module body 11 is preferably formed of metal, particularly a zinc alloy, a zinc aluminum alloy or another metal alloy melting at a temperature below 1.000° C. Particularly, the module body 11 can be formed as die-cast body.

The module body 11 hast substantially the form of a flat plate with a narrow side 20, at least one tool, here the tools 12-18, extending away therefrom. Additionally, the module body 11 comprises a substantially flat contact surface 21 that is in contact with a bar for accommodating and positioning the tools 12-18. At the opposite side of the module body 11 a substantially flat or also with additional structures provided backside is formed, that is substantially orientated parallel to the contact surface 21.

Particularly at the contact surface 21 as well as the transition to the narrow side 20 elements are provided that form an alignment structure 22 or that are part thereof. For example two cylinder-shaped projections 23, 24 are part of these elements that preferably extend parallel to each other away from the contact surface 21. The ends of the projection 23, 24 can be provided with an insertion chamfer, a rounded camber or the like. Alternatively, the projections 23, 24 can have a cross-sectional shape deviating from the circular shape as, for example, polygonal shapes or can be configured as rounded domes.

A ridge 26 provided with an interruption 25 can additionally or alternatively form part of the alignment structure 22 that is arranged between the narrow side 20 and the contact surface 21. The ridge 26 can be separated from the contact surface 20 by a groove 27—for this purpose reference is made particular to FIG. 4. The ridge 26 comprises preferably a support surface 21*a* orientated at a right angle with regard to the contact surface 21. In the assembled condition both contact surfaces 21, 21*a* are in contact with a bar. Preferably the cutout 25 is located with its bottom substantially in one plane with the contact surface 21. The remaining sections of the ridge 26 on both sides of the cutout 25 form teeth that come into contact with respective contact surfaces of a bar and thus define the axial position of the tools 12-18. The contact surface 21 however defines their lateral positioning.

As apparent from FIG. 5, the projections 23, 24 are arranged on one line 28 that is preferably orientated parallel to the groove 27 (if provided) as well as to the narrow side 20. On this line 28 or in the proximity thereof, a fastening opening 29 is additionally provided. The line 28 intersects the fastening opening 29, wherein the center point of the opening is preferably, but not obligatory, located on the line 28. The fastening opening 29 penetrates the contact surface 21 and the whole module body 11. The diameter of the preferably circular fastening opening 29 is preferably only slightly larger than the fastening element in order to achieve a weakening of the module body 11 in the proximity of the fastening opening 29 that is as low as possible. The fastening opening 29 can be surrounded from an insert 30 consisting for example of brass or another suitable material that is inserted in the die during the molding production of the module body 11. This allows the support of high fastening forces without damage of the module body 11 consisting of zinc die-cast or a similar material. The fastening opening 29 can be provided with an inner thread. It is however also possible to omit such an insert 30.

The module body 11 thus comprises a fastening section 31 that comprises the projections 23, 24 (if present) as well as the fastening opening 29. Further, the module body 11 comprises a holding section 32 into which the fastening ends of the shanks of the tools 12-18 extend. Between the fastening section 31 and the holding section 32 one, preferably multiple additional openings 33, 34 are provided in the module body 11 as particularly apparent from FIGS. 2, 3 and 5. The additional openings 33, 34 are configured with an area that is as large as possible and are preferably symmetrically arranged to a line that is defined by the center point of opening 29 and the center axis of the center tool 15. This applies for an uneven tool number. In case of an even tool number, the mirror axis to which the openings 33, 34 are symmetrically located is defined by a line that extends through the center point of the fastening opening 29 on one hand and in the middle between two tools on the other hand.

The additional opening 33 or 34 respectively comprises preferably a trapezoidal basic shape with rounded corners and overlaps with reference to the axial direction of the tools 12-18 (vertical direction in FIGS. 3 and 5) the respectively adjacent projection 23 or 24 as well as the fastening opening 29. By way of example of the additional opening 43 this is symbolized in FIG. 5 by two dashed lines 35, 36. If the projection 23 is missing the outer opening border of the opening 34 and thus the line 35 preferably extends through the outside located tool 18 anyway. The same applies for the opening 33 and the tool 12.

The long edge of the trapezoidal-shaped basic structure at the fastening opening facing the projection 23 can be bulged outwardly in an arc-shaped manner. Additionally, the corners are preferably rounded. In doing so, a connection structure is created between the fastening section 31 and the holding section 32 formed by three webs 33, 38, 39 (FIG. 3) via which the fastening section 31 is connected with the holding section 32. The two webs 37 and 39 preferably comprise a corresponding rectangular or square cross-section and are orientated parallel to each other and have equal length. The center web 38 can be configured shorter and is preferably aligned with the center tool 15. It is preferably orientated parallel to the outer webs 37, 39 and can have the same cross-section as the outer webs 37, 39 or can comprise a cross-section deviating therefrom. The outer tools 12, 18 can be aligned with the webs 37, 39.

The tool module 10 described so far is attached to a bar during operation in that it is brought in the desired position in the alignment structure 22 and fixed in this position. If present projections 23, 24 are inserted in corresponding cutouts of the bar and the rib or ridge 26 as well as the contact surface 21 are brought into contact with the bar. By means of a screw or a suitable corresponding means that extends in or through the fastening opening 29, the tool module is captively held at the bar.

In operation the bar oscillates substantially in axial direction of the tools 12-18 back and forth, wherein the tools 12-18 come into frictional engagement with the respective mostly two-dimensional textile and execute an operation at the same, for example piercing a thread therethrough, form loops or the like. The friction occurring at the tools 12-18 heats them, wherein the heat is introduced to a certain proportion in the module body 11. The reduced contact surface 21 impedes however the transfer of heat to the bar. Concurrently, the openings 33, 34 swirlingly act on the ambient air during fast back and forth movement of the bar and thus support the heat dissipation, particularly from the holding section 32. The webs 37, 38, 39 further reduce the heat transfer from the holding section 32 to the fastening section 31.

It is indicated that the additional openings 33, 34 lead to a weight reduction of the module body 11 such that its material choice can be made independent from the material density. The weight reduction reduces the dynamic stress of the bar and the machine parts guiding it during the oscillating back and forth movement of the bar which in turn allows an increase of the operating speed.

A tool module 10 according to the invention comprises a module body 11 with a contact surface 21 and an alignment structure 22. The contact surface 21 is penetrated by a fastening opening 29 and additionally by at least one, preferably multiple additional openings 33, 34. The area of an additional opening 33 or 34 is larger, preferably remarkably larger, for example at least two times or three times as large as the cross-section area of the fastening opening 29. In doing so, a module body 11 is provided with which an increased operation speed of the textile machine can be achieved.

LIST OF REFERENCE SIGNS

10 tool module
11 module body
12-18 tools
20 narrow side
21 contact surface
22 alignment structure
23, 24 projections
25 cutout
26 ridge
27 groove
28 line
29 fastening opening
30 insert
31 fastening section
32 holding section
33, 34 additional openings
35, 36 dashed lines
37, 38, 39 webs

The invention claimed is:

1. A tool module (10), particularly for tufting applications, comprising:

a module body (11) that comprises an alignment structure (22) including an abutment surface (21) for positioning at a bar, tools (12-18) held in the module body (11), a fastening opening (29) that penetrates the abutment surface (21) and the module body (11), at least one additional opening (33, 34) that penetrates the abutment surface (21) and the module body (11) that is separate from the fastening opening (19), wherein the at least one additional opening (33, 34) of the module body (11) is arranged in a zone between the fastening opening (29) and a ridge (26) arranged adjacent to a narrow side (20) of the module body (11) and serves as an alignment structure (22), and wherein the module body (11) is separated into a fastening section (31) and a tool holding section (32) by the at least one additional opening (33, 34), wherein the fastening section (31) and the tool holding section (32) are connected with each other via at least two webs (33, 38, 39).

2. The tool module according to claim 1, wherein the abutment surface (21) has a flat configuration.

3. The tool module according to claim 1, wherein the alignment structure (22) comprises projections (23, 24) extending away from the abutment surface (21).

4. The tool module according to claim 3, wherein the projections (23, 24) include two prismatic, cylinder-shaped or dome-shaped projections (23, 24) that extend parallel to each other away from the abutment surface (21).

5. The tool module according to claim 1, wherein the ridge is an interrupted or continuous ridge (26) and is part of the alignment structure (22) adjoining a narrow surface (20) of the module body (11) and extending beyond the abutment surface (21).

6. The tool module according to claim 4, wherein the projections (23, 24) are arranged on a reference line (28) that is oriented parallel to the ridge (26).

7. The tool module according to claim 6, wherein the fastening opening (29) is arranged on the reference line (28).

8. The tool module according to claim 1, wherein the fastening opening (29) is configured in an insert (30) provided with an inner thread.

9. The tool module according to claim 1, wherein the at least one additional opening comprises two openings (33, 34) that are separate from the fastening opening (29).

10. The tool module according to claim 9, wherein the two openings (33, 34) are configured mirror symmetrically to each other.

11. The tool module according to claim 6, wherein the at least one additional opening comprises two openings (33, 34) arranged on a second reference line that is parallel to the reference line (28) on which the projections (23, 24) are arranged.

12. The tool module according to claim 1, wherein the at least two webs (37, 38, 39) comprise equal cross-sections.

13. The tool module according to claim 1, wherein the module body (11) is a molded part.

* * * * *